US006857235B2

(12) United States Patent
Niday et al.

(10) Patent No.: US 6,857,235 B2
(45) Date of Patent: Feb. 22, 2005

(54) PROTECTIVE COVER FOR REINFORCING BAR

(75) Inventors: David A. Niday, Springboro, OH (US); Edward B. Sorauf, Fairborn, OH (US); Dale R. Haslem, Claremont, CA (US); Keith E. Keller, Parsons, KS (US); Harry B. Lancelot, III, Centerville, OH (US); Thomas E. Lannom, Dayton, OH (US)

(73) Assignee: Dayton Superior Corporation, Dayton, OH (US)

( * ) Notice: Subject to any disclaimer, the term of this patent is extended or adjusted under 35 U.S.C. 154(b) by 179 days.

(21) Appl. No.: 10/082,378

(22) Filed: Feb. 25, 2002

(65) Prior Publication Data

US 2002/0116887 A1 Aug. 29, 2002

Related U.S. Application Data

(60) Provisional application No. 60/271,109, filed on Feb. 23, 2001.

(51) Int. Cl.[7] ..... E04H 12/00

(52) U.S. Cl. ..... 52/301; 52/289.1; 52/300; 52/318; 52/689; 52/677; 52/669; 52/687; 74/552; 74/553; 74/551.1; 248/188.9; 248/523

(58) Field of Search ..... 52/685, 689, 154, 52/234, 677, 301, 698, 170; 248/188, 519, 523

(56) References Cited

U.S. PATENT DOCUMENTS

| | | | | |
|---|---|---|---|---|
| 1,083,120 A | | 12/1913 | May | 52/301 |
| 1,324,076 A | | 12/1919 | Smith | 52/301 |
| 1,345,111 A | | 6/1920 | Albrecht | 52/103 |
| 1,422,226 A | | 7/1922 | Schultz | 5/281 |
| 2,215,251 A | | 9/1940 | Prince | 138/96 |
| 3,007,726 A | | 11/1961 | Parkin | 403/372 |
| 3,199,819 A | | 8/1965 | Widmark | 248/188.9 |
| 3,233,502 A | | 2/1966 | Fernberg | 85/80 |
| 3,401,908 A | | 9/1968 | Rapata | 248/188.8 |
| 3,485,271 A | | 12/1969 | Halsey | 138/96 |
| 3,563,277 A | | 2/1971 | Klipper | 138/96 |
| 3,693,310 A | | 9/1972 | Middleton | 52/685 |
| 3,890,990 A | | 6/1975 | Schafer | 135/20 |
| 4,000,539 A | * | 1/1977 | Neyer | 16/441 |
| 4,012,806 A | | 3/1977 | Howie, Jr. | 16/121 |
| 4,080,770 A | | 3/1978 | Vigh | 52/689 |
| 4,119,290 A | | 10/1978 | Gies | 248/523 |
| 4,179,771 A | | 12/1979 | Rankins et al. | 16/121 |
| 4,202,378 A | | 5/1980 | Bush et al. | 138/96 |
| 4,269,010 A | | 5/1981 | Glass | 52/154 |

(List continued on next page.)

FOREIGN PATENT DOCUMENTS

| | | | |
|---|---|---|---|
| DE | 1157436 | 11/1963 | |
| DE | 1810356 | 6/1970 | |
| DE | 2534928 | 2/1976 | E04C/5/20 |
| DE | 4036919 | 5/1991 | E04C/5/20 |
| GB | 937601 | 9/1963 | |
| WO | WO91/14839 | 10/1991 | E04C/5/16 |

*Primary Examiner*—Brian E. Glessner
*Assistant Examiner*—Christy M. Green
(74) *Attorney, Agent, or Firm*—Wood, Herron & Evans, LLP

(57) ABSTRACT

A protective cover for a reinforcing bar including a collar structure defining a perimeter portion and having an open end for receiving the end of a rebar. A cap portion is connected to the collar structure oriented substantially perpendicularly to the collar structure and including a support portion formed integrally with the collar structure. The cap portion further includes a barrier plate supported on the support portion and defining an exposed upper surface of the cover. In one embodiment, a reinforcing plate is disposed beneath the barrier cover and defines an lower surface lower surface within an area defined by the perimeter portion of the collar structure.

80 Claims, 7 Drawing Sheets

U.S. PATENT DOCUMENTS

| | | | | | |
|---|---|---|---|---|---|
| D262,093 | S | | 12/1981 | Bush et al. | D8/386 |
| 4,575,978 | A | | 3/1986 | Huhn et al. | 52/234 |
| 4,623,756 | A | | 11/1986 | Wilson, Jr. | 174/158 |
| 4,644,726 | A | | 2/1987 | Wheeler | 52/677 |
| 4,655,023 | A | | 4/1987 | Yung | 52/685 |
| 4,680,428 | A | | 7/1987 | Wilson, Jr. | 174/158 |
| 4,694,863 | A | | 9/1987 | Klopp | 138/96 |
| 4,708,154 | A | * | 11/1987 | Edwards | 135/84 |
| 4,824,136 | A | * | 4/1989 | Baxter | 280/475 |
| 4,833,850 | A | * | 5/1989 | Lunn | 52/301 |
| 4,899,771 | A | * | 2/1990 | Wilkinson | 135/77 |
| 4,939,830 | A | | 7/1990 | Janian | 29/173 |
| 4,972,642 | A | | 11/1990 | Strobl, Jr. | 52/297 |
| 4,991,823 | A | | 2/1991 | Stanish, Jr. | 256/1 |
| 5,048,571 | A | | 9/1991 | Ellis | 138/96 |
| 5,103,850 | A | * | 4/1992 | Davis | 135/84 |
| 5,301,704 | A | * | 4/1994 | Brown | 135/78 |
| 5,307,828 | A | * | 5/1994 | Gardner et al. | 135/82 |
| 5,313,757 | A | * | 5/1994 | Schnepf | 52/301 |
| 5,363,618 | A | * | 11/1994 | Underwood | 52/301 |
| 5,381,636 | A | | 1/1995 | Kassardjian et al. | 52/301 |
| D362,336 | S | * | 9/1995 | Weaver | D3/17 |
| 5,447,290 | A | | 9/1995 | Workman | 256/59 |
| D363,657 | S | | 10/1995 | Kassardjian et al. | D8/354 |
| 5,523,043 | A | * | 6/1996 | Kassardjian et al. | 264/273 |
| 5,568,708 | A | | 10/1996 | Kassardjian et al. | 52/301 |
| 5,600,927 | A | * | 2/1997 | Kennon | 52/301 |
| 5,613,336 | A | * | 3/1997 | Workman | 52/301 |
| 5,687,772 | A | | 11/1997 | Underwood | 138/96 |
| 5,706,860 | A | | 1/1998 | Gonyea | 138/96 |
| 5,729,941 | A | * | 3/1998 | Kassardjian et al. | 52/301 |
| 5,826,398 | A | | 10/1998 | Carnicle | 52/698 |
| 5,826,606 | A | * | 10/1998 | Davenport | 135/82 |
| 5,884,443 | A | * | 3/1999 | Schimmelpfennig et al. | 52/301 |
| 5,906,344 | A | * | 5/1999 | Atkinson et al. | 248/188.9 |
| D412,615 | S | * | 8/1999 | Brightbill et al. | D3/17 |
| 5,943,836 | A | * | 8/1999 | Kassardjian | 52/301 |
| 5,946,871 | A | | 9/1999 | Kassardjian et al. | 52/301 |
| 5,992,434 | A | * | 11/1999 | Berlin et al. | 135/77 |
| 6,073,415 | A | | 6/2000 | Carnicle | 52/698 |
| 6,085,478 | A | * | 7/2000 | Workman | 52/301 |
| 6,131,593 | A | * | 10/2000 | Greene et al. | 135/77 |
| 6,199,333 | B1 | * | 3/2001 | Viduka, Jr. | 52/300 |
| 6,662,514 | B2 | * | 12/2003 | Workman | 52/300 |

* cited by examiner

PROTECTIVE COVER FOR REINFORCING BAR

CROSS-REFERENCE

The present application claims the filing benefit of U.S. Provisional Application Serial No. 60/271,109, filed Feb. 23, 2001, the disclosure of which is hereby incorporated herein by reference in its entirety.

FIELD OF THE INVENTION

The present invention generally relates to a protective cover for reinforcing bars and, more particularly, to a protective cover used during construction for placement over the end of reinforcing bars in order to prevent injuries to workers.

BACKGROUND OF THE INVENTION

During construction of buildings, bridges and other structures incorporating concrete, it is common to have reinforcing bars embedded in the structure, and it is not uncommon during the construction for one end of a rebar to be embedded in concrete while the opposing end remains exposed. The protruding ends of the reinforcing bars present a hazard to workers who may fall or otherwise contact the end of the bar.

To prevent impalement, it is known to attach a plastic cap to an exposed end of a rebar. Further, it is known to provide such caps with a steel plate incorporated therein, such as by molding within the plastic cap, to add strength thereto and further resist puncturing of the cap in response to application of a force, such as a worker falling against the end of the rebar. Typical examples of such caps are illustrated in U.S. Pat. Nos. 5,729,941, 5,943,836 and 5,946,871.

The present invention is directed to a further improvement in protective covers for reinforcing bars.

SUMMARY OF THE INVENTION

The present invention overcomes the foregoing and other shortcomings and drawbacks of protective covers heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the present invention, a protective cover is provided for use on the end of concrete reinforcing bars, the protective cover generally including a collar structure, a cap portion oriented substantially perpendicularly to the collar structure, and a barrier plate defining an exposed upper surface of the cover.

In an embodiment of the invention, the collar structure and cap portion are formed of a molded material wherein the collar structure defines a perimeter portion including an inner perimeter portion having an open end for receiving the end of a rebar. The perimeter portion of the collar structure further comprises an outer perimeter portion and the cap portion includes a laterally extending support portion which extends radially outwardly from the outer perimeter portion and is located beneath the barrier plate.

In a further aspect of the invention, the barrier plate is provided with apertures, and the material forming the cap portion extends through the apertures to define connector portions extending between the support portion of the cap and the exposed upper surface. The connector portions terminate in enlarged head portions on the exposed upper surface of the barrier plate to facilitate retention of the barrier plate on the cap portion.

In a further aspect of the invention, the barrier plate is formed with a quadrilateral shape, and is further formed with a double curvature such that the edges of the barrier plate curve downwardly toward the collar structure.

In an additional aspect of the invention, the collar structure may be formed with a pair of concentric collar members, including an inner collar member and an outer collar member. The inner collar member defines the inner perimeter portion for receiving the end of the rebar, and the outer collar member defines the outer perimeter portion. The inner collar member is connected to the outer collar member by means of a plurality of ribs.

In accordance with yet another aspect of the invention, a reinforcing plate is disposed beneath the barrier plate to further enhance the resistance of the barrier plate to penetration by the end of the rebar when an impact load is exerted against an upper surface of the protective cover.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
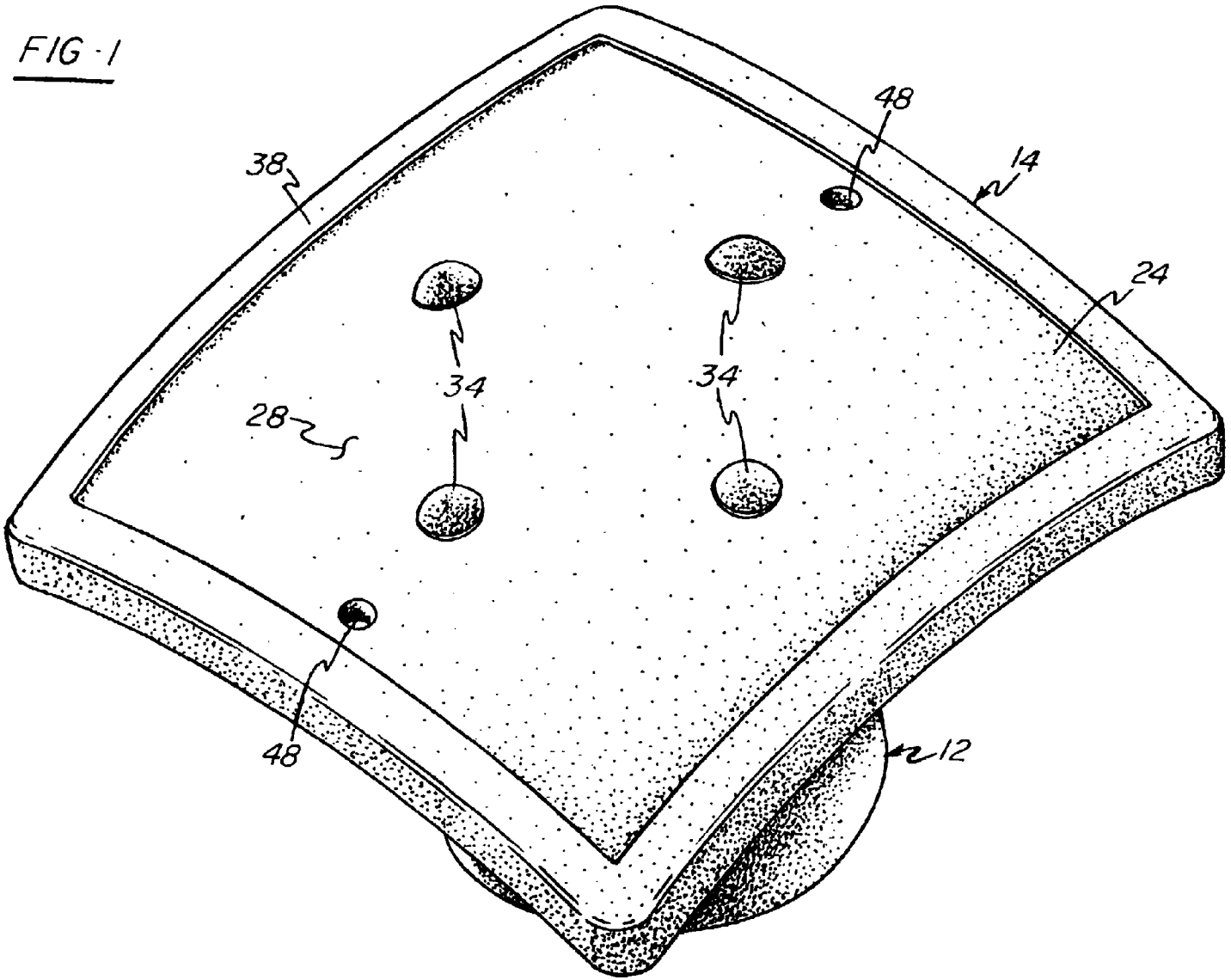
FIG. 1 is a top perspective view of the protective cover of the present invention.
Figure 2:
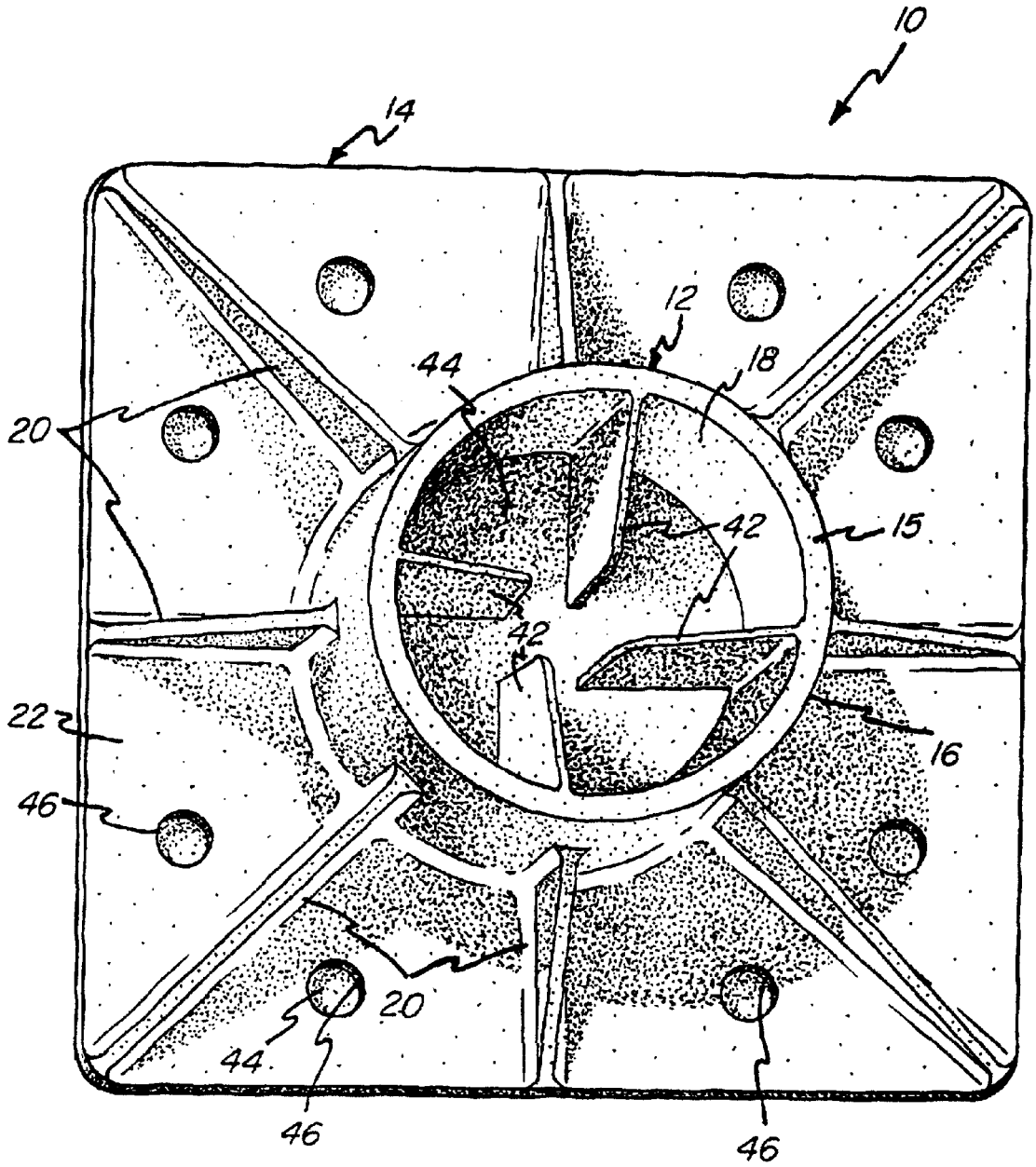
FIG. 2 is a bottom perspective view of the protective cover.

Referring to FIGS. 1 and 2, the protective cover 10 of the present invention includes a collar structure 12 and a cap portion 14 wherein the collar structure 12 and cap portion 14 are formed of a molded plastics material and are formed integrally with each other.

Referring to FIG. 2, the collar structure 12 defines a perimeter portion 15 including an outer perimeter portion defining an outer wall surface 16 and an inner perimeter portion defining an inner wall surface 18. In the embodiment disclosed herein, the collar structure 12 comprises a cylindrical structure, and the cap portion 14 comprises a quadrilateral and is specifically illustrated as having a square shape. The collar structure 12 is further supported to the cap portion 14 by support ribs 20 extending from a lower surface 22 of the cap portion 14 to the outer wall 16 of the collar structure 12.

Figure 4:
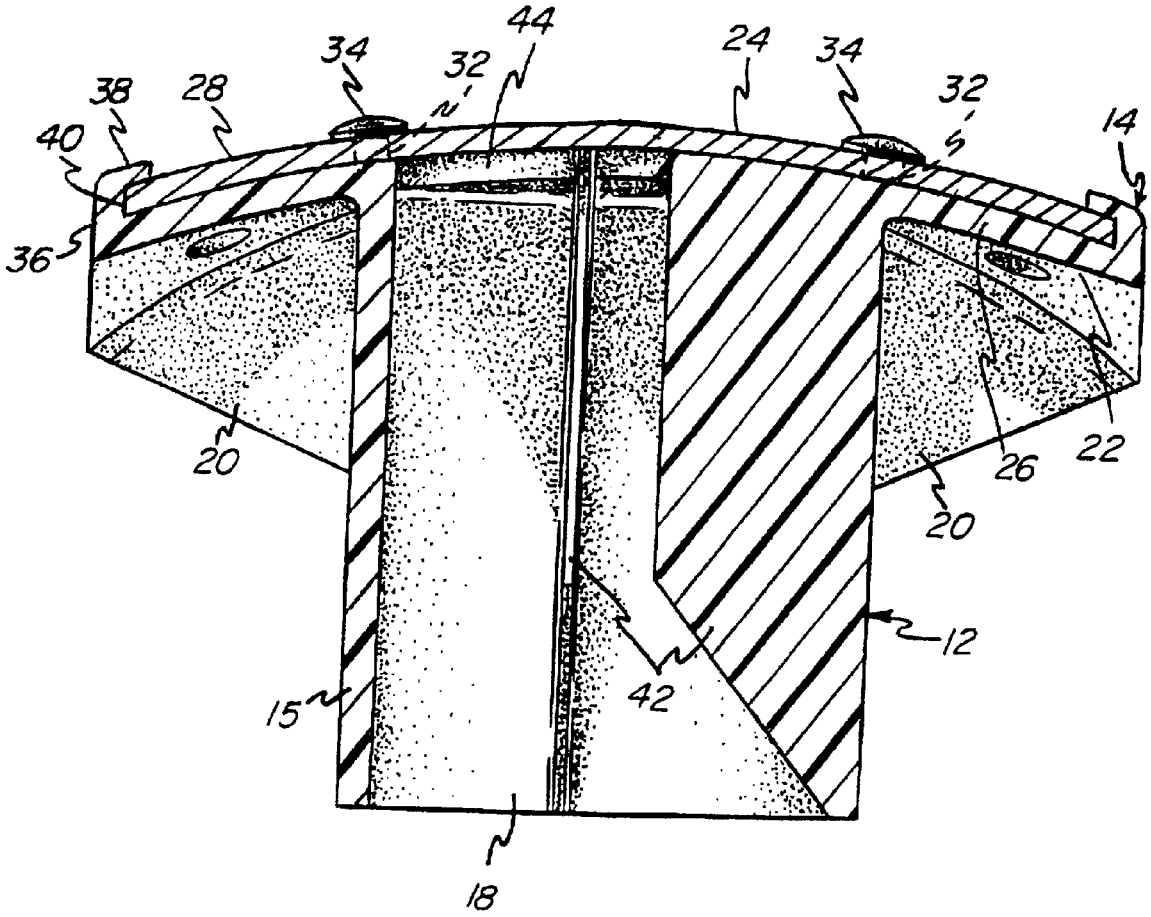
FIG. 4 is a cross-sectional view taken through the c enter of the protective cover.

Referring to FIGS. 1 and 4, the cap portion 14 additionally comprises a barrier plate 24 which is supported on a support portion 26 of the cap portion 14 wherein the support portion 26 defines the lower surface 22. The barrier plate 24 defines an exposed upper surface 28 of the cover 10 and is formed of a material which is resistant to penetration by the end of a rebar when an impact load is exerted against the upper surface 28 of the cover 10. The impact-resistant material of the barrier plate 24 may include a metal, such as steel, or a synthetic material exhibiting sufficient structural strength properties to resist penetration, such as Kevlar.

Figure 5:
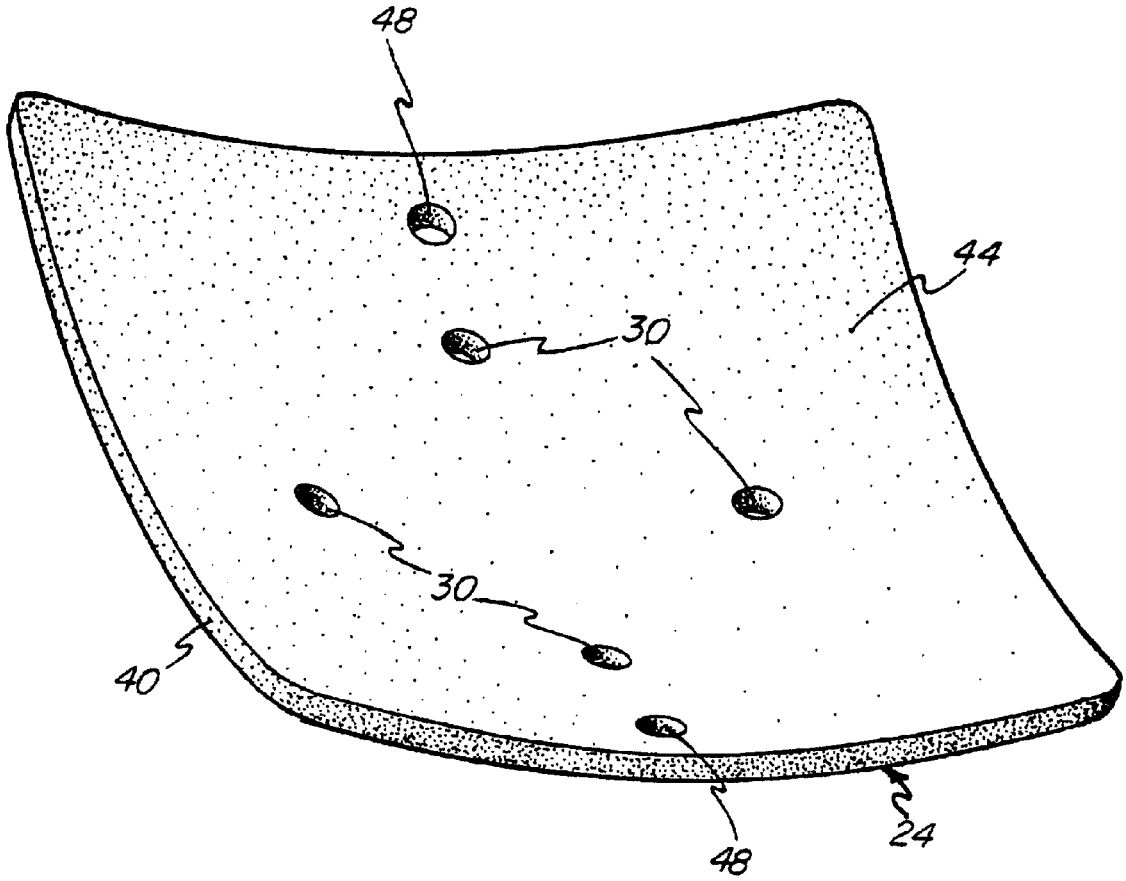
FIG. 5 is a bottom perspective view of the barrier plate.

The barrier plate 24 is formed in a quadrilateral shape, and is formed with a double curvature such that the barrier plate 24 is bowed downwardly over the end of the rebar when the cover 10 is in place. The barrier plate 24 is provided with a plurality of apertures 30 therethrough (see FIG. 5), and a portion of the material of the support portion 26 extends through the apertures 30 to define connector portions 32 which terminate in enlarged head portions 34 located on the upper surface 28 of the barrier plate 24. The enlarged head portions 34 facilitate retention of the barrier plate 24 in position on the support portion 26. In addition, the support portion 26 is formed with an upwardly extending peripheral edge 36 and a flange portion 38 which extends inwardly over the exposed upper surface 28 adjacent a peripheral edge 40 thereof. Thus, the barrier plate 24 is effectively held in position on the support portion 26 of the cap portion 14 by means of the enlarged heads 34 and peripheral flange 40 which are formed during the molding operation of the support portion 24 and collar structure 12.

Figure 3:
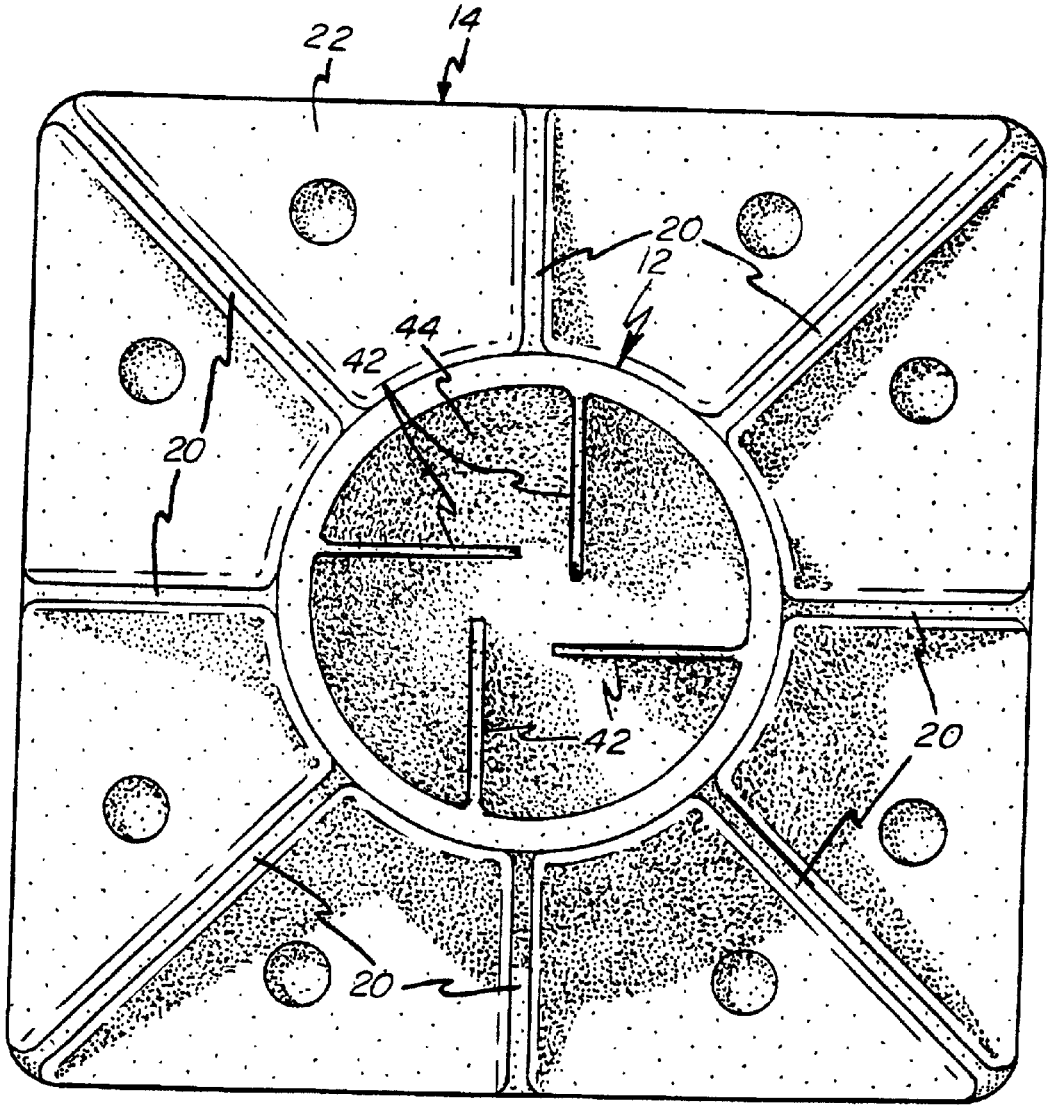
FIG. 3 is a bottom plan view of the protective cover.

Referring to FIGS. 2–4, it can be further seen that the collar structure 12 is formed with a plurality of fins 42 molded integrally with the inner wall 18 of the collar structure 12 and extending radially inwardly for engaging the outer surface of a rebar to thereby frictionally retain the cover 10 on the end of the rebar. Further, it may be noted that the fins 42 extend inwardly at positions offset from the diametrical center of the collar structure 12. The fins 42 extend upwardly to locations adjacent to a lower surface 44 of the barrier plate 24, and the area within the perimeter portion 14 adjacent to the lower surface 44 of the barrier plate 24 is formed as an open area, such that the fins 42 will be provided with a degree of movement relative to the lower surface 44 of the barrier plate 24 to permit flexure of the fins 42 relative to the perimeter portion 15.

Referring to FIGS. 2 and 3, it should be noted that the support portion 26 of the cap portion 14 includes a plurality of apertures 46. The apertures 46 extend to the lower surface 44 of the barrier plate 24 and are formed as a consequence of a lower molding member (not shown) for forming the support portion 26 being provided with a plurality of pins (not shown) for pressing the barrier plate 24 up against an upper molding member (not shown) in order to facilitate pressing the barrier plate 24 into a desired position during the molding operation. Further, it should be noted that the barrier plate 24 is provided with two apertures 48 for receiving alignment pins (not shown) located in the upper molding member (not shown) in order to facilitate alignment of the barrier plate 24 within the upper molding plate during the molding operation.

Figure 6:
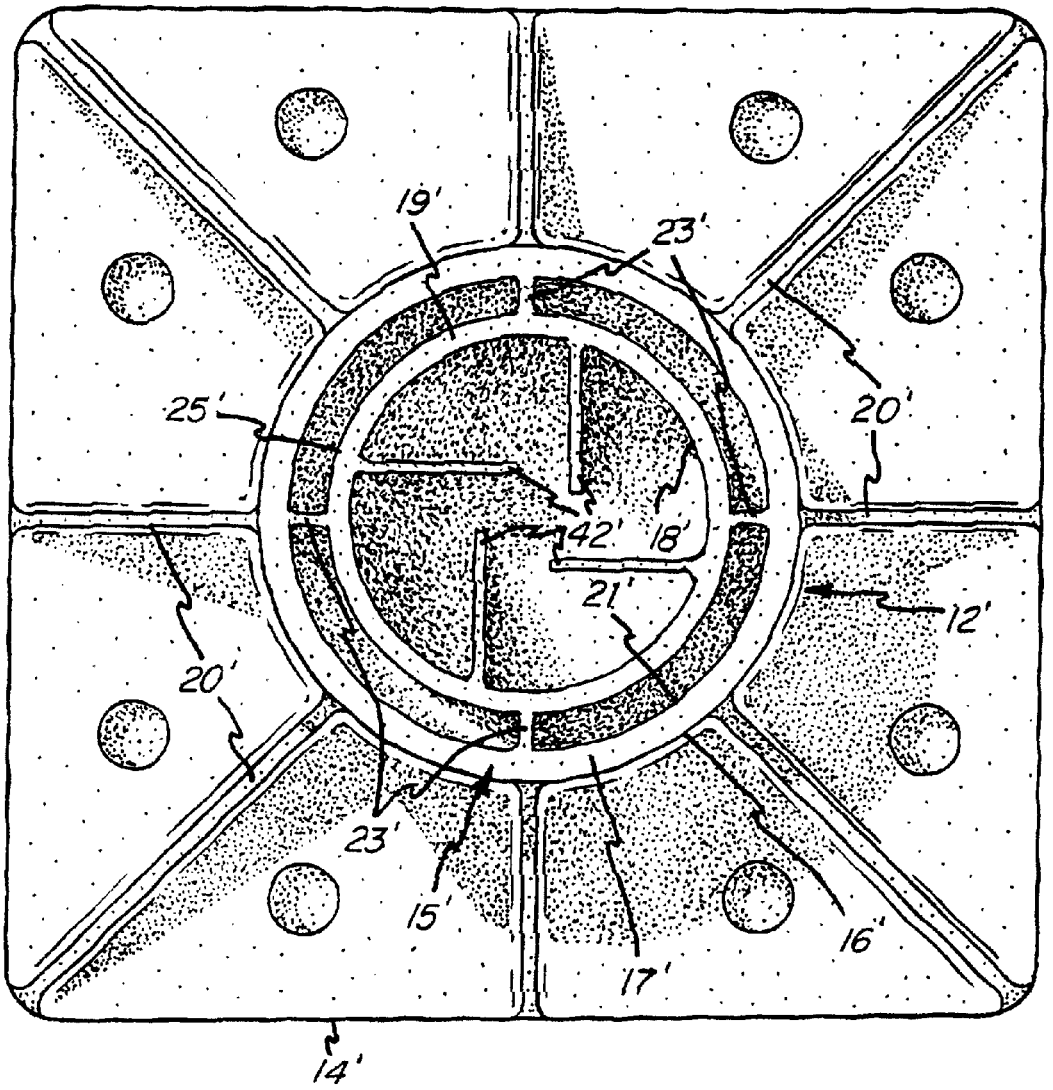
FIG. 6 is a bottom plan view of an alternative embodiment of the protective cover of the present invention.

Referring to FIG. 6, an alternative embodiment of the protective cover is illustrated in which elements corresponding to the previous embodiment are labeled with the same reference numeral primed. As in the previous embodiment, the present embodiment includes a collar structure 12' and a cap portion 14' wherein the cap portion 14' is formed in a manner substantially similar to that of the previous embodiment.

The collar structure 12' defines a perimeter portion 15' comprising an outer perimeter portion 17' and an inner perimeter portion 19' wherein the inner and outer perimeter portions 17', 19' are illustrated as substantially cylindrical structures extending from the lower surface 22' of the support portion 26'.

The inner perimeter portion 19' defines an inner wall 18' supporting fins 42' similar to the previous embodiment. The outer perimeter portion 17' defines an outer wall 18' and an inner wall 21', and a plurality of spacer ribs 23' extend between the inner wall 21' of the outer perimeter portion 17' and an outer wall 25' of the inner perimeter portion 19' to provide lateral support for the inner perimeter portion 19'.

The embodiment of FIG. 6 permits the protective cover of the present invention to be molded with two alternative collar structures 12, 12', depending on the diameter of rebar that the cover is intended to be placed upon. Specifically, the first embodiment may be used for rebar structures having a large diameter, and the embodiment illustrated in FIG. 6 may be used on rebars having a smaller diameter. Further, it should be noted that both embodiments may be formed using the same basic mold, but incorporating a different insert portion in the lower mold half (not shown) in order to form the different collar structures 12, 12'.

Figure 7:
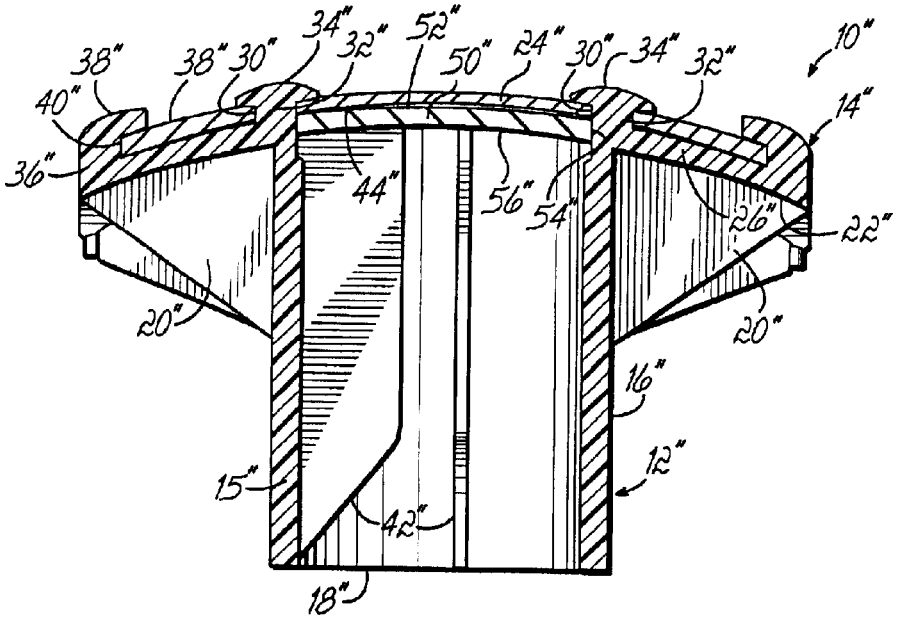
FIG. 7 is a cross-sectional view taken through the center of a protective cover having a reinforcing plate disposed beneath the barrier plate in accordance with yet another alternative embodiment of the present invention.
Figure 8:
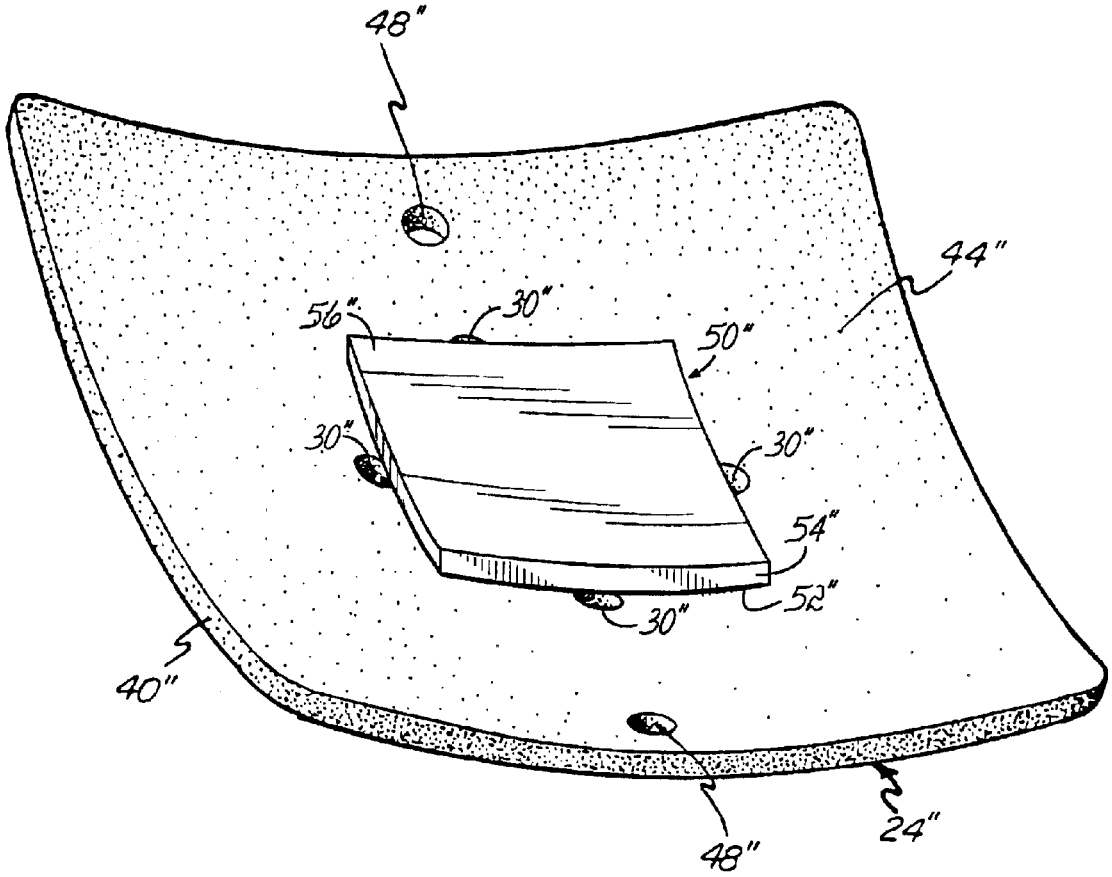
FIG. 8 is a bottom perspective view of the barrier plate and reinforcing plate of the protective cover of FIG. 7.

Referring now to FIGS. 7 and 8, another alternative embodiment of the protective cover is illustrated in which elements corresponding to the first embodiment of FIGS. 1–5 are labeled with the same reference numeral double primed. As in the first embodiment, the present embodiment includes a collar structure 12" and a cap portion 14" wherein the cap portion 14" is formed in a manner substantially similar to that of the first embodiment of FIGS. 1–5.

A reinforcing plate 50" is disposed beneath the barrier plate 24"to further enhance the resistance of the barrier plate 24" to penetration by the end of the rebar when an impact load is exerted against the upper surface 28" of the cover 10". The reinforcing material of the reinforcing plate 50" may include a metal, such as steel, or any other suitable reinforcing material exhibiting sufficient structural strength properties to resist penetration in combination with the barrier plate 24".

Referring to FIG. 8, the reinforcing plate 50" is formed in a quadrilateral shape, and is formed with a double curvature substantially conforming to the double curvature of the barrier plate 24". The reinforcing plate 50" has an upper surface 52" disposed adjacent the lower surface 44" of the barrier plate 24", and the reinforcing plate 50" may be welded, bonded, glued, fastened or otherwise suitably secured in intimate contact with the barrier plate 24" to form a composite laminate structure. Alternatively, the reinforcing plate 50" may be supported adjacent to the lower surface 44" of the barrier plate 24" without being secured thereto.

As shown in FIGS. 7 and 8, the reinforcing plate 50" has a peripheral edge 54" that is bounded by the apertures 30" formed through the barrier plate 24". The fins 42" extend upwardly to locations adjacent to a lower surface 56" of the reinforcing plate 50", and the area within the perimeter portion 14" adjacent to the lower surface 56" of the reinforcing plate 50" is formed as an open area, such that the fins 42" will be provided with a degree of movement relative to the lower surface 56" of the reinforcing plate 50" to permit flexure of the fins 42" relative to the perimeter portion 15". The lower surface 56" of the reinforcing plate 50" is exposed within an area defined by the perimeter portion 15" against which in use the end of the rebar bears when an impact load is exerted against the upper surface 28" of the cover 10". The cover 10" has structurally resistant properties to resist penetration of the cover 10" by the end of the rebar in response to an impact load.

While the forms of apparatus herein described constitute preferred embodiments of this invention, it is to be understood that the invention is not limited to these precise forms of apparatus and that changes may be made therein without departing from the scope of the invention which is defined in the appended claims.

What is claimed is:

1. A protective cover for a concrete reinforcing bar comprising:

a collar structure defining an open end for receiving the end of a rebar;

a cap portion having a support portion extending outwardly from said collar structure; and a barrier plate supported by said support portion and defining an exposed upper surface of the cover, wherein a portion of said support portion is disposed adjacent said exposed upper surface so as to extend over said barrier plate and said exposed upper surface defined thereby.

2. A protective cover as in claim 1 wherein said barrier plate includes apertures and material of said cap portion extends through said apertures to define connector portions extending between said cap portion and said exposed upper surface.

3. A protective cover as in claim 2 wherein said connector portions terminate in enlarged head portions located on said exposed upper surface.

4. A protective cover as in claim 1 wherein said barrier plate comprises an impact resistant material capable of resisting penetration by the end of a rebar located in said collar structure.

5. A protective cover as in claim 4 wherein said barrier plate comprises a metal plate.

6. A protective cover as in claim 5 wherein said barrier plate comprises a steel plate.

7. A protective cover as in claim 4 wherein said barrier plate comprises a Kevlar plate.

8. A protective cover as in claim 1 wherein said barrier plate comprises a curved plate.

9. A protective cover as in claim 1 wherein said barrier plate comprises a quadrilateral shape.

10. A protective cover as in claim 9 wherein said barrier plate is formed with a double curvature.

11. A protective cover as in claim 1 wherein said barrier plate defines an outer edge and said cap portion extends around said outer edge and defines a flange portion extending over said exposed upper surface adjacent to said outer edge.

12. A protective cover as in claim 1 wherein said collar structure comprises a pair of concentric collar members.

13. A protective cover as in claim 12 wherein said pair of collar members comprises an inner collar member and an outer collar member spaced from said inner collar member by a plurality of ribs.

14. A protective cover for a concrete reinforcing bar comprising:

a collar structure defining an open end for receiving the end of a rebar;

a cap portion having a support portion extending outwardly from said collar structure;

a barrier plate supported by said support portion and defining an exposed upper surface of the cover; and a reinforcing plate disposed adjacent a lower surface of said barrier plate, wherein a portion of said support portion is disposed adjacent said exposed upper surface so as to extend over said barrier plate and said upper exposed upper surface defined thereby.

15. A protective cover as in claim 14 wherein said barrier plate includes apertures and material of said cap portion extends through said apertures to define connector portions extending between said cap portion and said exposed upper surface.

16. A protective cover as in claim 15 wherein said connector portions terminate in enlarged head portions located on said exposed upper surfaces.

17. A protective cover as in claim 14 wherein said barrier plate comprises an impact resistant material capable of resisting penetration by the end of a rebar located in said collar structure.

18. A protective cover as in claim 17 wherein said barrier plate comprises a metal plate.

19. A protective cover as in claim 18 wherein said barrier plate comprises a steel plate.

20. A protective cover as in claim 17 wherein said barrier plate comprises a Kevlar plate.

21. A protective cover as in claim 17 wherein said reinforcing plate comprises a metal plate.

22. A protective cover as in claim 21 wherein said reinforcing plate comprises a steel plate.

23. A protective cover as in claim 14 wherein said barrier plate comprises a curved plate.

24. A protective cover as in claim 14 wherein said barrier plate comprises a quadrilateral shape.

25. A protective cover as in claim 24 wherein said barrier plate is formed with a double curvature.

26. A protective cover as in claim 14 wherein said reinforcing plate comprises a curved plate.

27. A protective cover as in claim 14 wherein said reinforcing plate comprises a quadrilateral shape.

28. A protective cover as in claim 27 wherein said reinforcing plate is formed with a double curvature.

29. A protective cover as in claim 14 wherein said barrier plate defines an outer edge and said cap portion extends around said outer edge and defines a flange portion extending onto said exposed upper surface adjacent to said outer edge.

30. A protective cover as in claim 14 wherein said reinforcing plate is mounted to said barrier plate.

31. A protective cover for a concrete reinforcing bar comprising:

a collar structure defining an open end for receiving the end of a rebar;

a cap portion having a support portion extending outwardly from said collar structure; and a barrier plate supported by said support portion and defining an exposed upper surface of the cover;

wherein said barrier plate includes apertures end material of said cap portion extends through said apertures to define connector portions extending between said cap portion and said exposed upper surface and said connector portions terminate in enlarged head portions located on said exposed upper surface,

32. A protective cover as in claim 31 wherein said barrier plate comprises an impact resistant material capable of resisting penetration by the end of a rebar located in said collar structure.

33. A protective cover as in claim 32 wherein said barrier plate comprises a metal plate.

34. A protective cover as in claim 33 wherein said barrier plate comprises a steel plate.

35. A protective cover as in claim 32 wherein said barrier plate comprises a Kevlar plate.

36. A protective cover as in claim 31 wherein said barrier plate comprises a curved plate.

37. A protective cover as in claim 31 wherein said barrier plate comprises a quadrilateral shape.

38. A protective cover as in claim 37 wherein said barrier plate is formed with a double curvature.

39. A protective cover as in claim 31 wherein said barrier plate defines an outer edge and said cap portion extends around said outer edge and defines a flange portion extending over said exposed upper surface adjacent to said outer edge.

40. A protective cover as in claim 31 wherein said collar structure comprises a pair of concentric collar members.

41. A protective cover as in claim 40 wherein said pair of collar members comprises an inner collar member and an outer collar member spaced from said inner collar member by a plurality of ribs.

42. A protective cover for a concrete reinforcing bar comprising:

a collar structure defining an open end for receiving the end of a rebar;

a cap portion having a support portion extending outwardly from said collar structure; and a barrier plate supported by said support portion and defining an exposed upper surface of the cover;

wherein said barrier plate defines an outer edge and said cap portion extends around said outer edge and defines a flange portion extending over said exposed upper surface adjacent to said outer edge.

43. A protective cover as in claim 42 wherein said barrier plate comprises an impact resistant material capable of resisting penetration by the end of a rebar located in said collar structure.

44. A protective cover as in claim 43 wherein said barrier plate comprises a metal plate.

45. A protective cover as in claim 44 wherein said barrier plate comprises a steel plate.

46. A protective cover as in claim 43 wherein said barrier plate comprises a Kevlar plate.

47. A protective cover as in claim 42 wherein said barrier plate comprises a curved plate.

48. A protective cover as in claim 42 wherein said barrier plate comprises a quadrilateral shape.

49. A protective cover as in claim 48 wherein said barrier plate is formed with a double curvature.

50. A protective cover as in claim 42 wherein said collar structure comprises a pair of concentric collar members.

51. A protective cover as in claim 50 wherein said pair of collar members comprises an inner collar member and an outer collar member spaced from said inner collar member by a plurality of ribs.

52. A protective cover for a concrete reinforcing bar comprising:

a collar structure defining an open end for receiving the end of a rebar;

a cap portion having a support portion extending outwardly from said collar structure;

a barrier plate supported by said support portion and defining an exposed upper surface of the cover; and a reinforcing plate disposed adjacent a lower surface of said barrier plate;

wherein said barrier plate includes apertures and material of said cap portion extends through said apertures define connector portions extending between said cap portion and said exposed upper surface and said connector portions terminate in enlarged head portions located on said exposed upper surface.

53. A protective cover as in claim 52 wherein said barrier plate comprises an impact resistant material capable of resisting penetration by the end of a rebar located in said collar structure.

54. A protective cover as in claim 53 wherein said barrier plate comprises a metal plate.

55. A protective cover as in claim 54 wherein said barrier prate comprises a steel plate.

56. A protective cover as in claim 53 wherein said barrier plate comprises a Kevlar plate.

57. A protective cover as in claim 53 wherein said reinforcing plate comprises a metal plate.

58. A protective cover as in claim 57 wherein said reinforcing plate comprises a steel plate.

59. A protective cover as in claim 52 wherein said barrier plate comprises a curved plate.

60. A protective cover as in claim 52 wherein said barrier plate comprises a quadrilateral shape.

61. A protective cover as in claim 60 wherein said barrier plate is formed with a double curvature.

62. A protective cover as in claim 52 wherein said reinforcing plate comprises a curved plate.

63. A protective cover as in claim 52 wherein said reinforcing plate comprises a quadrilateral shape.

64. A protective cover as in claim 63 wherein said reinforcing plate is formed with a double curvature.

65. A protective cover as in claim 52 wherein said barrier plate defines an outer edge and said cap portion extends around said outer edge end defines a flange portion extending onto said exposed upper surface adjacent to said outer edge.

66. A protective cover as in claim 52 wherein said reinforcing plate is mounted to said barrier plate.

67. A protective cover for a concrete reinforcing bar comprising:

a collar structure defining an open end for receiving the end of a rebar;

a cap portion having a support portion extending outwardly from said collar structure;

a barrier plate supported by said support portion and defining an exposed upper surface of the cover; and a reinforcing plate disposed adjacent a lower surface of said barrier plate;

wherein said barrier plate defines an outer edge and said cap portion extends around said outer edge and defines a flange portion extending over said exposed upper surface adjacent to said outer edge.

68. A protective cover as in claim 67 wherein said barrier plate comprises an impact resistant material capable of resisting penetration by the end of a rebar located in said collar structure.

69. A protective cover as in claim 68 wherein said barrier plate comprises a metal plate.

70. A protective cover as in claim 69 wherein said barrier plate comprises a steel plate.

71. A protective cover as in claim 68 wherein said barrier plate comprises a Kevlar plate.

72. A protective cover as in claim 68 wherein said reinforcing plate comprises a metal plate.

73. A protective cover as in claim 72 wherein said reinforcing plate comprises a steel plate.

74. A protective cover as in claim 67 wherein said barrier plate comprises curved plate.

75. A protective cover as in claim 67 wherein said barrier plate comprises a quadrilateral shape.

76. A protective cover as in claim 75 wherein said barrier plate is formed with a double curvature.

77. A protective cover as in claim 67 wherein said reinforcing plate comprises a curved plate.

78. A protective cover as in claim 67 wherein said reinforcing plate comprises a quadrilateral shape.

79. A protective cover as in claim 78 wherein said reinforcing plate is formed with a double curvature.

80. A protective cover as in claim 67 wherein said reinforcing plate is mounted to said barrier plate.

* * * * *

UNITED STATES PATENT AND TRADEMARK OFFICE

CERTIFICATE OF CORRECTION

PATENT NO. : 6,857,235 B2
DATED : February 22, 2005
INVENTOR(S) : David A. Niday It is certified that error appears in the above-identified patent and that said Letters Patent is hereby corrected as shown below:

Title page,
Item [57], ABSTRACT,
Lines 9-12, change "In one embodiment, a reinforcing plate is disposed beneath the barrier cover and defines an lower surface lower surface within an area defined by the perimeter portion of the collar structure." to -- In one embodiment, a reinforcing plate is disposed beneath the barrier cover and defines a lower surface within an area defined by the perimeter portion of the collar structure. --.

Column 6,
Line 9, change "and said upper exposed upper surface defined thereby." to -- and said upper exposed surface defined thereby. --.

Column 8,
Line 7, change "of said cap portion extends through said apertures define connector portions extending" to -- of said cap portion extends through said apertures to define connector portions extending --.
Line 39, change "around said outer edge end defines a flange portion" to -- around said outer edge and defines a flange portion --

Column 9,
Line 6, change "wherein said barrier plate comprises curved plate." to -- wherein said barrier plate comprises a curved plate. --.

Signed and Sealed this

Second Day of August, 2005

JON W. DUDAS
*Director of the United States Patent and Trademark Office*